US009234394B2

(12) United States Patent
Wheater et al.

(10) Patent No.: US 9,234,394 B2
(45) Date of Patent: Jan. 12, 2016

(54) LOW FRICTION WIRELINE STANDOFF

(76) Inventors: Guy Wheater, Scarborough (GB); Stuart Huyton, Elgin (GB)

( * ) Notice: Subject to any disclaimer, the term of this patent is extended or adjusted under 35 U.S.C. 154(b) by 465 days.

(21) Appl. No.: 12/871,218

(22) Filed: Aug. 30, 2010

(65) Prior Publication Data

US 2012/0031609 A1 Feb. 9, 2012

(51) Int. Cl.
*E21B 17/10* (2006.01)

(52) U.S. Cl.
CPC ..... *E21B 17/1057* (2013.01)

(58) Field of Classification Search
CPC ..... E21B 17/10; E21B 17/1057; E21B 19/24
USPC ..... 166/241.1, 241.3, 241.4, 241.5, 241.6
See application file for complete search history.

(56) References Cited

U.S. PATENT DOCUMENTS

| | | | | |
|---|---|---|---|---|
| 3,125,382 | A | 3/1964 | Herndon, Jr. et al. | |
| 3,692,109 | A | 9/1972 | Grayson | |
| 4,372,622 | A * | 2/1983 | Cheek | 175/325.3 |
| 5,522,467 | A * | 6/1996 | Stevens et al. | 175/73 |
| 5,692,563 | A * | 12/1997 | Krueger et al. | 166/85.5 |
| 6,209,667 | B1 * | 4/2001 | Murray et al. | 175/325.3 |
| 6,250,394 | B1 * | 6/2001 | Mashburn | 166/382 |
| 6,250,406 | B1 * | 6/2001 | Luke | 175/325.2 |
| 6,260,617 | B1 * | 7/2001 | Baugh et al. | 166/241.3 |
| 6,382,333 | B1 * | 5/2002 | Murray | 175/325.3 |
| 6,779,598 | B2 * | 8/2004 | Hall | 166/66.4 |
| 7,048,064 | B1 | 5/2006 | Smith | |
| 7,188,689 | B2 * | 3/2007 | Maxwell et al. | 175/325.2 |
| 7,395,881 | B2 * | 7/2008 | McKay et al. | 175/325.3 |
| 7,403,000 | B2 * | 7/2008 | Barolak et al. | 324/221 |
| 7,866,384 | B2 * | 1/2011 | Hall | 166/241.3 |
| 8,245,779 | B2 * | 8/2012 | Lemke et al. | 166/241.6 |
| 8,733,455 | B2 * | 5/2014 | Shaikh et al. | 166/380 |
| 8,919,436 | B2 * | 12/2014 | Maxwell et al. | 175/325.3 |
| 2001/0020530 | A1 | 9/2001 | Eaton | |
| 2005/0252655 | A1 * | 11/2005 | McKay et al. | 166/241.7 |
| 2012/0018145 | A1 * | 1/2012 | Wheater et al. | 166/241.5 |
| 2012/0255744 | A1 * | 10/2012 | Shaikh et al. | 166/380 |
| 2013/0248206 | A1 * | 9/2013 | Jordan et al. | 166/381 |

FOREIGN PATENT DOCUMENTS

| | | |
|---|---|---|
| CA | 1062154 | 9/1979 |
| GB | 2393984 A | 4/2004 |
| GB | 2450918 A | 1/2009 |

OTHER PUBLICATIONS

UK Intellectual Property Office Search Report for Application No. GB0713550.2 dated Mar. 12, 2008.

* cited by examiner

*Primary Examiner* — Elizabeth Gitlin
(74) *Attorney, Agent, or Firm* — Tumey L.L.P.

(57) ABSTRACT

The low friction wireline standoff reduces or eliminates contact of the wireline cable with the borehole wall during the logging operation. The low friction wireline standoff comprises external wheels mounted on two finned half shells that clamp onto the wireline with precision cable inserts.

20 Claims, 5 Drawing Sheets

LOW FRICTION WIRELINE STANDOFF

CROSS-REFERENCE TO RELATED APPLICATIONS

The present application claims priority to United Kingdom Patent Application No. GB1013292.6, entitled "Low Friction Wireline Standoff," filed on Aug. 7, 2010, the entire disclosure of which is incorporated herein by reference.

BACKGROUND

This invention relates to a device that improves wireline cable performance during logging operations in a variety of boreholes. The use of low friction wireline standoffs ameliorates the effects of wireline cable differential sticking, wireline cable key-seating, and high cable drags by reducing or eliminating the contact of the wireline cable with the borehole wall during the logging operation.

Wireline logging is a common operation in the oil industry whereby down-hole electrical tools are conveyed on wireline (also known as "e-line" in industry parlance) to evaluate formation lithologies and fluid types in a variety of boreholes. In certain wells there is a risk of the wireline cable and/or logging tools becoming stuck in the open hole due to differential sticking or key-seating, as explained below.

Key-seating happens when the wireline cable cuts a groove into the borehole wall. This can happen in deviated or directional wells where the wireline cable may exert considerable sideways pressure at the contact points with the borehole. Since the logging tool diameter is generally much bigger than the groove cut by the wireline cable a keyseat can terminate normal ascent out of the borehole and result in a fishing job or lost tools in hole.

Differential sticking can occur when there is an overbalance between hydrostatic and formation pressures in the borehole; the severity of differential sticking is related to:

- The degree of overbalance and the presence of any depleted zones in the borehole.
- The character and permeability of the formations bisected by the borehole.
- The deviation of the borehole, since the sideways component of the tool weight adds to the sticking forces.
- The drilling mud properties in the borehole, since the rapid formation of thick mud cakes can trap logging tools and the wireline cable against the borehole wall.
- The geometry of toolstring being logged on wireline. A long and large toolstring presents a larger cross sectional area and results in proportionally larger sticking forces.

Additionally, during wireline formation sampling, the logging tools and wireline may remain stationary over permeable zones for a long period of time which also increases the likelihood of differential sticking.

SUMMARY

This invention ameliorates the effects of differential sticking and key-seating of the wireline cable by reducing or eliminating direct contact of the cable to the borehole wall. This is achieved by clamping an array of low friction wireline standoffs onto the wireline cable, resulting in a lower contact area per unit length of open hole, lower applied sideways pressure of the wireline against the borehole wall, and lower cable drag when conveying the wireline in or out of the hole. The use of low area standoffs also enables more efficient use of wireline jars in the logging string since they reduce the cable friction above the jars, allowing firing at lower surface tensions and easier re-rocking of the jars in boreholes where high cable drag is a problem (absorbing the applied surface tension before it can reach the wireline cable head and jars).

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of the present invention and should not be used to limit or define the invention.

FIG. 3*a* shows an example close up view of the low friction wireline standoff on the wireline cable in relation to the borehole wall.

DETAILED DESCRIPTION

Figure 1:
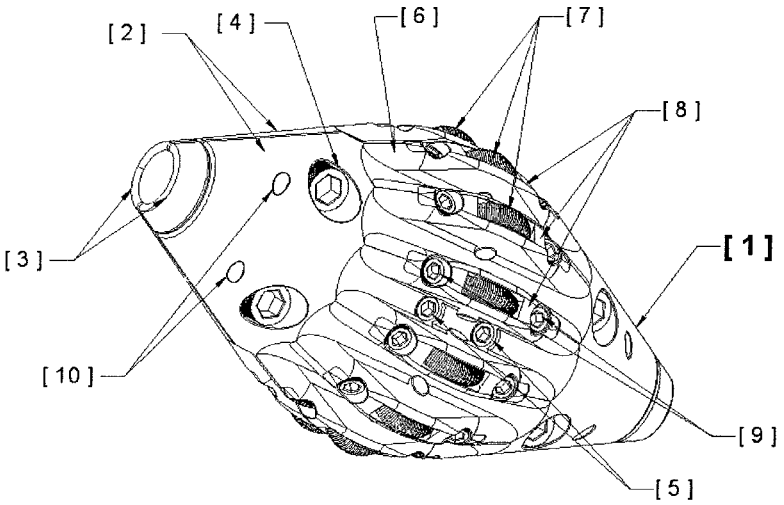
FIG. 1 is an isometric view of the wireline standoff before being clamped onto the wireline.

An array of low friction wireline standoffs can be installed on the wireline cable to minimize the wireline cable contact over a selected zone(s) of the open hole section. The low friction wireline standoffs may be installed on the wireline cable to either straddle known permeable zones where differential sticking is a risk (e.g., eliminating cable contact 100%) or they can be placed at regular intervals along the wireline cable to minimize keyseating, taking into account the dog leg severity of the borehole. The higher the dogleg severity the shorter the recommended spacing between wireline standoffs installed on the wireline cable. The spacing of wireline standoffs on the cable may be from 10's of feet to 100's of feet, depending on the requirements for the particular borehole being logged.

In accordance with present embodiments, each low friction wireline standoff comprises two opposing assemblies which mate together onto the wireline cable. In an embodiment, the opposing assemblies clamp together on the wireline cable with four cap head bolts. The assemblies comprise two stainless steel half shells with exterior wheels and two disposable cable inserts on the interior. In one embodiment, the assemblies comprise twelve exterior wheels. In an exemplary embodiment, contact with the wireline cable exterior is solely with the cable inserts made from aluminum, and not the stainless steel half shells. In one embodiment, the cable inserts are designed to slightly deform around the outer wireline cable armour during installation without physically damaging the wireline cable. There are a large range of cable inserts available to fit the wireline cable, taking into account any manufacturing tolerances and varying degrees of wear or distortion along the length of the wireline cable. Therefore, for an array of low area standoffs installed on the wireline cable a range of different cable inserts may be employed to ensure a fit which does not allow slippage along the wireline cable or damage to the wireline cable when clamped. The four cap head bolts that clamp the two assemblies together are torqued to a consistently safe limit with a calibrated torque wrench.

In certain embodiments, the stainless steel half shells are vacuum hardened for improved wear resistance during use and a range of shell sizes are available for installation on the wireline, for example, from 50 mm O.D. upwards. The aluminum cable inserts are positively secured into each stainless half shell by small cap head bolts that pass through the outside of each half shell into tapped holes in the cable insert bodies. The cable inserts have zero freedom of movement inside the half shells because:

a) a central spigot eliminates rotation of the cable inserts in the half shells.

b) a central flange on the cable inserts ensures no axial movement in the half shells.

The low friction wireline standoff may further include a plurality of fins along its length. In an embodiment, the low friction wireline standoff has 12 fins cut along its length, each fin holding a wheel sub assembly. The wheels rotate in plain bearings machined in the bodies of the half shells and are clamped in position with slotted wheel retainers and cap head bolts. The wheels reduce the standoff rolling resistance which results in lower tensions and cable drags inside casing and the open borehole.

The wheels also minimize contact area of the standoff assemblies with the borehole wall and reduce the differential sticking force acted upon each wheel at the contact points with the borehole. They also allow easy rotation of the standoffs if the wireline cable rotates when it is deployed and retrieved from the borehole. Note that it is the general nature of wireline logging cable to rotate during logging operations due to the opposing lay angles of the inner and outer armours which can induce unequal torsional forces when tensions are applied. The design of the shells and wheels allows easy rotation of the wireline cable during the logging operation, avoiding the potential for damage if excessive torque was allowed to build up.

In addition, the low friction wireline standoff may further include a plurality of holes in the half shells for use in installation. In an embodiment, four holes in the standoff half shells are used to connect a lanyard during installation, to avoid dropped objects on the drill floor during installation on the wireline cable.

In accordance with certain embodiments, the maximum external diameter of the low friction wireline standoff is less than the size of overshot and drill pipe i.d. during fishing operations. In the event of a fishing job, the array of low area standoffs will safely fit inside the fishing assembly provided by the Operator, enabling the wireline cable head or tool body to be successfully engaged by the fishing overshot. The wireline cable and low friction wireline standoff array may then be safely pulled through the drill pipe all the way to surface when the cable head is released from the logging string.

The invention will now be described in detail with the aid of FIGS. 1-8, as summarized below. Note that "low friction wireline standoff" implies the full assembly of aforementioned components i.e. the stainless steel half shells and wheel sub assemblies, the aluminum cable inserts, and the associated cap head bolts.

The low friction wireline standoff 1 as seen in FIG. 1 comprises twelve exterior wheels mounted in two stainless steel half shells 2 and two internal aluminum cable inserts 3 which clamp directly onto the wireline cable using four cap head bolts 4. The cable inserts are secured in their half shells by two fully recessed small cap head bolts 5. Twelve external fins 6 and wheel sub assemblies on the low friction wireline standoff aid easy passage along the borehole and casing in the well. Each fin 6 supports a wheel sub assembly comprising a high strength wheel and axle 7, and a slotted wheel retainer 8, secured by a pair of cap head bolts 9. Each wheel is profiled for axial grip whilst minimizing the rolling resistance and contact area with the borehole, and also allowing for standoff rotation under the action of cable torque. The empty space between the fins and wheel sub assemblies allow for circulation of drilling mud inside drill pipe if the wireline cable and standoff assembly are fished using drill pipe. Holes across the two half shells 10 permit the fitting of a lanyard to avoid dropping them during their installation onto the wireline cable on the drill floor.

Figure 2:
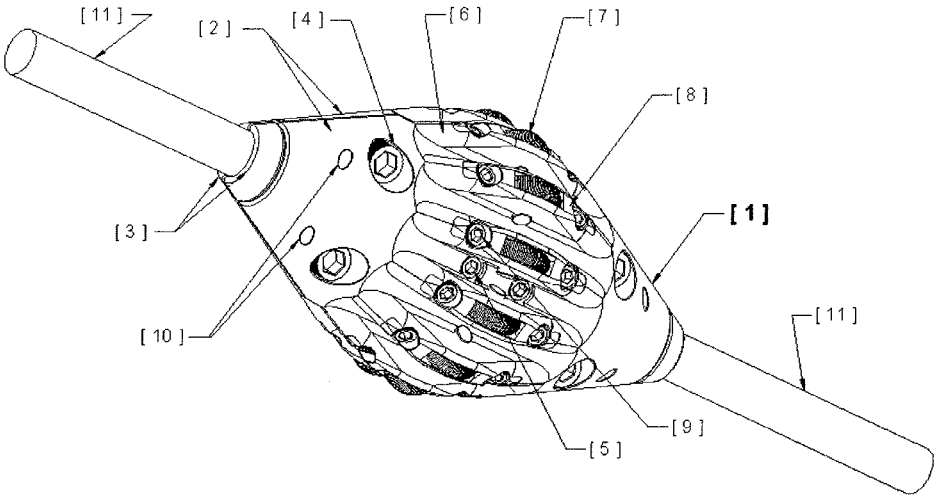
FIG. 2 is an isometric view of the low friction wireline standoff clamped onto a short section of wireline.

As depicted in FIG. 2, a short section of the wireline cable 11 passes through the central bore of the cable inserts 3 in the low friction wireline standoff 1. The wireline cable diameter may vary between 10-15 mm, depending on the logging vendor. The cable inserts are carefully matched to the diameter of the wireline cable regardless of any variations in size or profile that might occur along the length of the wireline cable. The cable inserts can be made from aluminum which is considerably softer than the armour material of the wireline cable. An accurate fit of the cable inserts on the wireline cable and the controlled torque of the four cap head bolts 4 during installation ensures that the cable inserts cannot damage the wireline cable when the bolts are tightened, pulling the two half shells 2 together.

Figure 3:
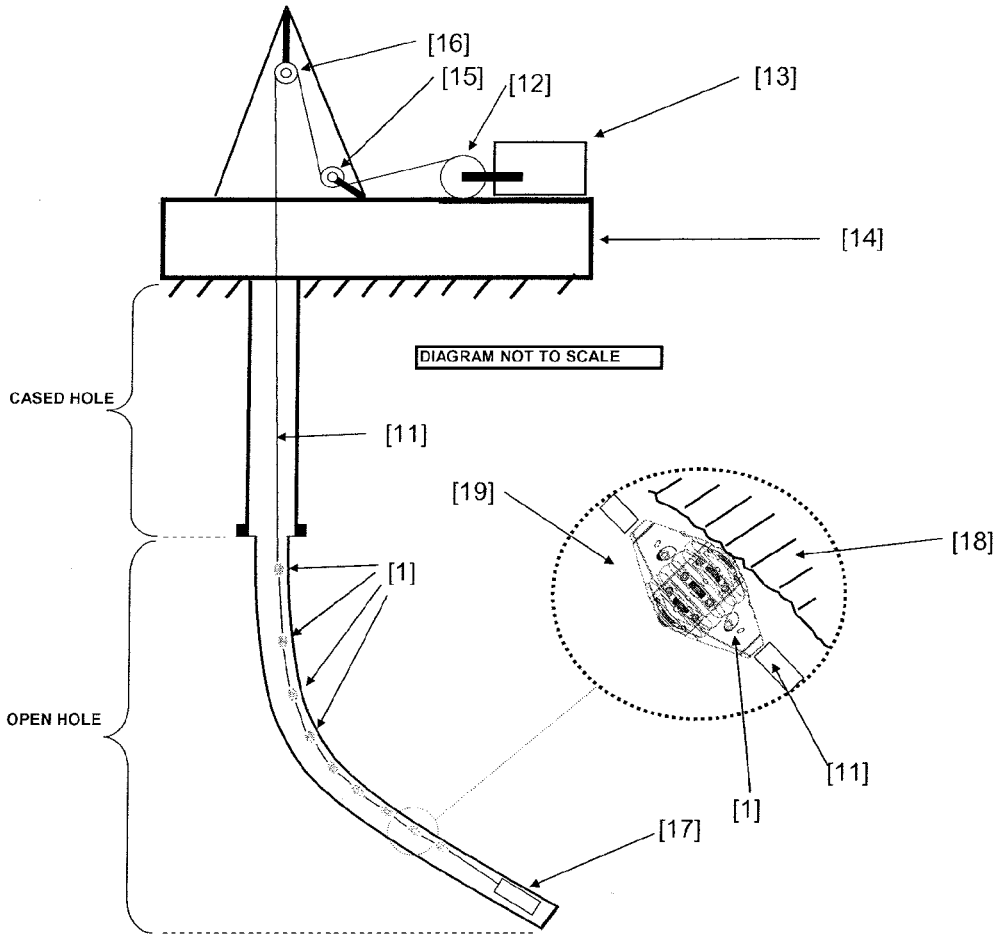
FIG. 3 illustrates an array of low friction wireline standoffs installed on a wireline cable in the borehole during borehole logging operations.

FIG. 3 shows a generic logging operation and low friction wireline standoff deployment. An array of low friction wireline standoffs 1 is clamped onto the wireline cable 11 which is stored on the wireline drum 12 and spooled into the well by a winch driver and logging engineer in the logging unit 13. The logging unit is fixed firmly to the drilling rig or platform 14 and the wireline is deployed through the derrick via two or three sheaves 15 and 16 to the maximum depth of the well. The logging tool connected to the end of the wireline cable 17 takes the petro-physical measurements or fluid or rock samples in the open hole section. The number of standoffs and their positions on the wireline are determined by the length of the open hole section, the location of sticky, permeable, or depleted zones, and the overall trajectory of the well, which may be deviated or directional in nature. As per the close up illustration in FIG. 3*a* the low friction wireline standoff 1 can be seen in relation to the wireline cable 11 and the borehole wall 18 and the borehole 19.

Figure 4:
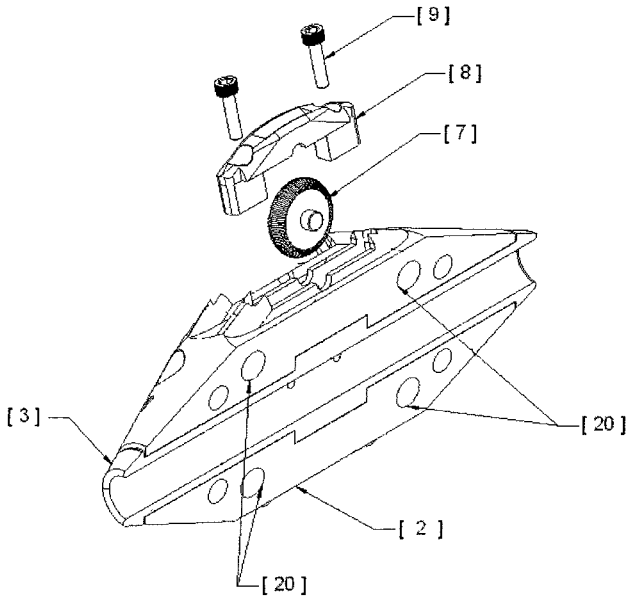
FIG. 4 is an isometric exploded view of the low friction wireline standoff with a single wheel sub assembly and one half shell removed, to illustrate the fitting of the aluminum cable insert.
Figure 4A:
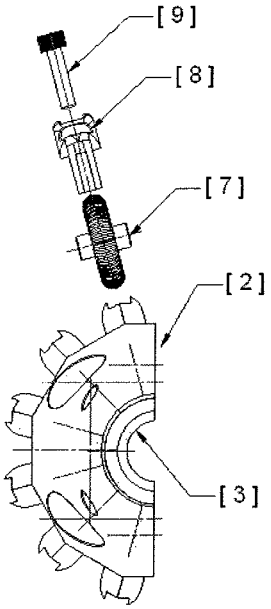
FIG. 4*a* is an end view of the same components in FIG. 4.

FIGS. 4 and 4*a* show the low friction wireline standoff with the lower half shell 2 removed such that the upper half shell 2 with cable insert in-situ 3 can be viewed. Included is a semi-exploded view of a single wheel sub assembly that illustrates the wheel and axle 7 and slotted wheel retainer 8, with pair of cap head bolts 9 to hold them in the half shell 2. In FIG. 4 the four holes 20 in the upper half shell 2 allow accurate mating to the lower half shell via high strength dowel pins, eliminating any shear stress on the four cap head bolts that clamp the shells onto the wireline.

Figure 5:
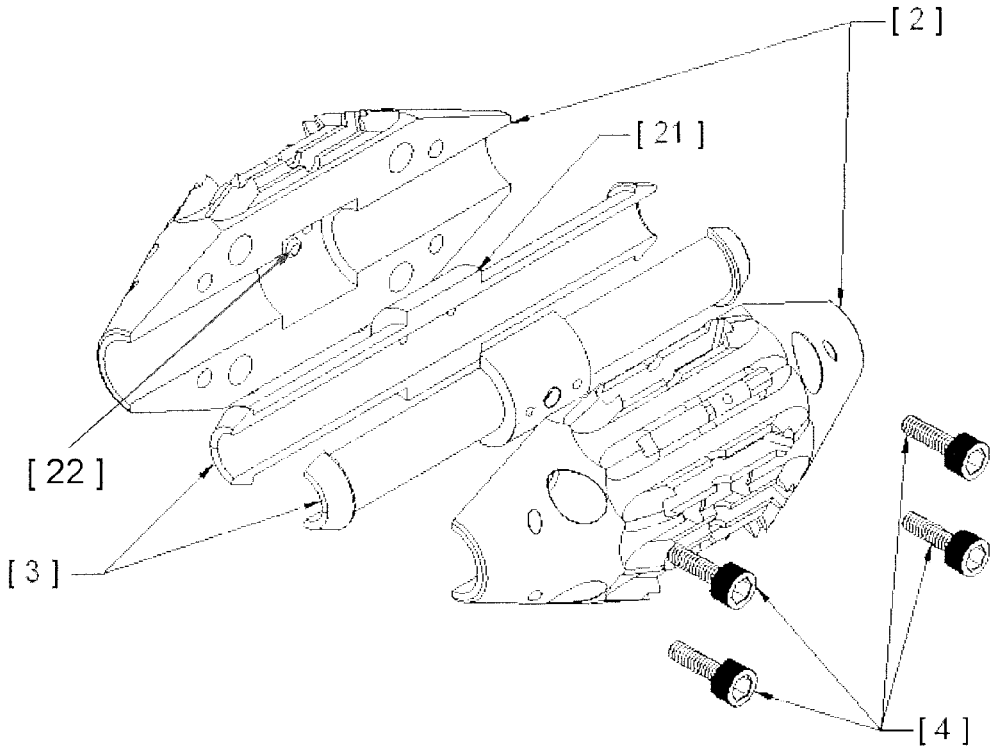
FIG. 5 is an exploded view of the half shells and cable inserts that make up each low friction wireline standoff assembly. The 12 wheel sub assemblies have been omitted for the sake of clarity.

FIG. 5 shows an exploded view of the low friction wireline standoff with the main components exposed: half shells 2, cable inserts 3, and four clamping bolts 4. The twelve wheel sub assemblies are not included for the sake of clarity. The cable insert flange 21 and anti-rotation spigot 22 eliminate any relative movement between the half shells and cable inserts.

Figure 6:
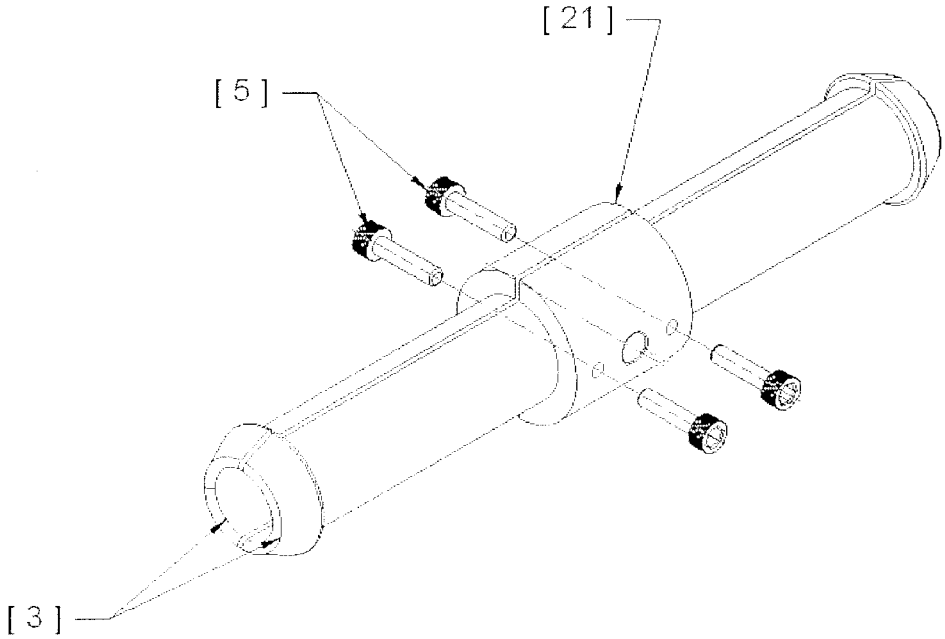
FIG. 6 illustrates the use of small cap head screws to hold the cable inserts inside the half shells.

FIG. 6 shows an exploded view of the cable inserts 3 with small cap head screws 5 that retain them in the half shells. The cable insert flange 21 and anti-rotation spigot 22 are clearly visible. The ends of the cable inserts are chamfered to avoid pinching the wireline cable.

Figure 7:
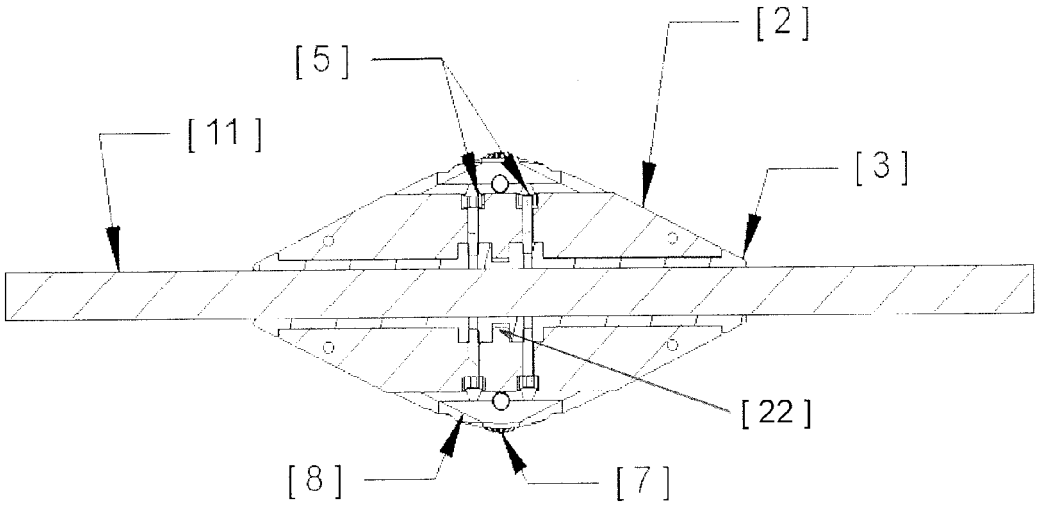
FIG. 7 illustrates a cross section of the half shell, cable inserts, cap head fixing screws and wireline cable.

FIG. 7 shows a cross section of the standoff installed on the wireline cable 11. It includes the cable insert 3 with small cap head screws 5 that retain them in the half shells 2. A partial view of the wheels 7 and wheel retainers 8 can also be seen in the cross section.

Figure 8:
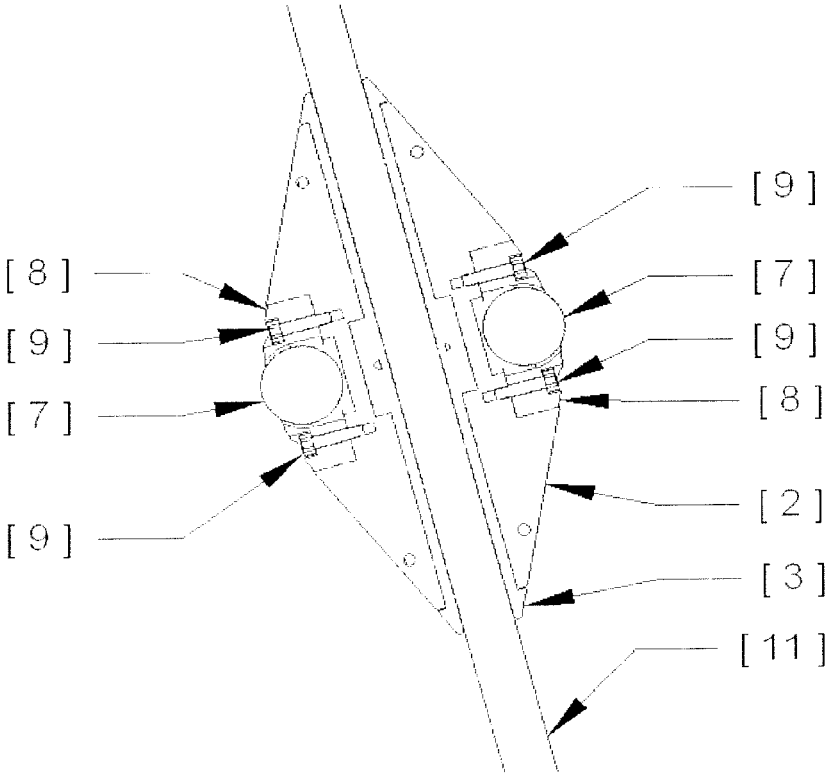
FIG. 8 illustrates a cross section of the low friction wireline standoff assembly in a plane bisecting two opposing wheel sub assemblies.

FIG. 8 shows a cross section of the low friction standoff installed on the wireline cable 11, in a plane which cuts through opposing wheel sub assemblies. It includes the half shell 2 and cable insert 3. The wheels and axles 7 are held in place with slotted wheel retainers 8 and cap head screws 9.

Although the present invention and its advantages have been described in detail, it should be understood that various changes, substitutions and alterations may be made herein without departing from the spirit and scope of the invention as defined by the appended claims.

What is claimed is:

1. A low friction wireline standoff, comprising:

adjacent opposing half shells, external wheels mounted on the opposing half shells, and cable inserts disposed in the opposing half shells, the cable inserts comprising a casing and configured for clamping onto a wireline cable;

wherein an anti-rotation spigot is mounted within at least one of the opposing half shells;

wherein the low friction wireline standoff is clamped around a portion of the wireline cable;

wherein the wireline standoff comprises an interior; and wherein the wireline cable extends through the interior of the wireline standoff.

2. The low friction wireline standoff according to claim 1 further comprising twelve banks, wherein at least one wheel is within each of the banks.

3. The low friction wireline standoff according to claim 1 wherein the wireline standoff has an axis, wherein the wireline standoff is profiled along the axis with an angle of attack that supports smooth movement along a borehole and past any obstructions when running the wireline in or out of the borehole.

4. The low friction wireline standoff according to claim 3 further comprising external fins and wheel sub assemblies, wherein the external fins and wheel sub assemblies have a smooth radial cross sectional area to minimize the fin contact with a borehole wall and allow easy rotation as the wireline is deployed and retrieved from the borehole.

5. The low friction wireline standoff according to claim 3 further comprising external fins and wheel sub assemblies, wherein the external fins and wheel sub assemblies allow the easy circulation of drilling mud past the standoff assembly during a fishing operation.

6. The low friction wireline standoff according to claim 1 wherein the half shells comprise external fins and wheel sub assemblies that aid conveyance of the wireline and the wireline standoff through cased hole and open hole sections of a borehole.

7. The low friction wireline standoff according to claim 1 wherein the cable inserts are machined from aluminum and configured to deform slightly during installation onto the wireline.

8. The low friction wireline standoff according to claim 1 wherein a maximum external diameter of the wireline standoff is less than a size of overshot and drill pipe inner diameter during a fishing operation.

9. A low friction wireline standoff, comprising:

a first assembly comprising a first half shell, a first cable insert comprising about half a casing, wherein the first cable insert is disposed in the first half shell, and first exterior wheels coupled to the first half shell; and a second assembly comprising a second half shell, a second cable insert comprising about half the casing, wherein the second cable insert is disposed in the second half shell, and second exterior wheels coupled to the second half shell; and wherein the first assembly and the second assembly are configured to mate together to clamp around a portion of a wireline cable;

wherein the first half shell and the second half shell are opposite and adjacent to each other;

wherein an anti-rotation spigot is mounted within the first half shell and the second half shell;

wherein the mated first and second assembly comprise an interior; and wherein the wireline cable extends through the interior of the mated first and second assembly.

10. The low friction wireline standoff according to claim 9 wherein an exterior portion of the first assembly and an exterior portion of the second assembly are profiled on their axes.

11. The low friction wireline standoff according to claim 9 wherein the first half shell comprises radially distributed external fins, and wherein the second half shell comprises radially distributed external fins.

12. The low friction wireline standoff according to claim 11 wherein the external fins of the first half shell each hold a wheel sub assembly, the wheel sub assembly comprising one of the first exterior wheels.

13. The low friction wireline standoff according to claim 9 wherein the low friction wireline standoff includes a total of twelve fins cut along a length of the first assembly and the second assembly, and wherein the first exterior wheels and the second exterior wheels comprise a total of twelve wheels.

14. The low friction wireline standoff according to claim 9 wherein the first cable insert and the second cable insert are each manufactured from aluminum.

15. A wireline assembly comprising:

a wireline cable;

a low friction wireline standoff;

wherein the low friction wireline standoff comprises adjacent opposing half shells, external wheels mounted on the opposing half shells, wherein the external wheels are secured by a detachable slotted wheel retainer; and cable inserts comprising a casing and a cable insert flange are disposed in the opposing half shells, the cable inserts being coupled to the wireline cable;

wherein the wireline standoff comprises an interior; and wherein the wireline cable extends through the interior of the wireline standoff.

16. The wireline assembly according to claim 15 wherein the low friction wireline standoff comprises an axis, and wherein an exterior portion of the low friction wireline standoff is profiled along the axis.

17. The wireline assembly according to claim 15 wherein the opposing half shells comprise radially distributed external fins.

18. The wireline assembly according to claim 17 wherein the external fins each hold a wheel sub assembly, the wheel sub assembly comprising one of the exterior wheels.

19. The wireline assembly according to claim 15 wherein the low friction wireline standoff includes a total of twelve fins cut along a length of the opposing half shells, and wherein the exterior wheels comprise a total of twelve wheels.

20. The wireline assembly according to claim 15 wherein the cable inserts are manufactured from aluminum.

* * * * *